US006688351B2

(12) United States Patent
Stager et al.

(10) Patent No.: US 6,688,351 B2
(45) Date of Patent: Feb. 10, 2004

(54) ADJUSTABLE PROFILING HEAD FOR A WOOD CUTTING APPARATUS

(75) Inventors: Bradley R. Stager, Beaverton, OR (US); John S. Luecke, Milwaukie, OR (US)

(73) Assignee: Key Knife, Inc., Tualatin, OR (US)

( * ) Notice: Subject to any disclaimer, the term of this patent is extended or adjusted under 35 U.S.C. 154(b) by 0 days.

(21) Appl. No.: 10/081,444

(22) Filed: Feb. 20, 2002

(65) Prior Publication Data

US 2003/0155038 A1 Aug. 21, 2003

(51) Int. Cl.[7] ..... B27C 11/00; B27C 1/00; B27C 5/00

(52) U.S. Cl. ..... 144/373; 144/39; 144/218; 144/231; 144/235; 144/237

(58) Field of Search ..... 184/39, 218, 222, 184/223, 225, 231, 237, 238, 363, 235, 220, 373; 409/46, 101; 29/428, 525.01

(56) References Cited

U.S. PATENT DOCUMENTS

| | | | | | |
|---|---|---|---|---|---|
| 3,780,778 | A | | 12/1973 | Chapman | |
| 3,976,112 | A | | 8/1976 | Rowlson et al. | |
| 4,269,244 | A | * | 5/1981 | Kinsella | 144/231 |
| 4,327,789 | A | | 5/1982 | Reuter | |
| 4,335,767 | A | | 6/1982 | Reuter | |
| 4,848,427 | A | | 7/1989 | Reuter | |
| 5,316,061 | A | * | 5/1994 | Lee | 144/218 |
| 5,421,386 | A | | 6/1995 | Lundstrom | |
| 5,433,563 | A | * | 7/1995 | Velepec | 144/231 |
| 6,021,828 | A | * | 2/2000 | Snair | 144/237 |
| 6,058,992 | A | * | 5/2000 | Stager et al. | 144/235 |
| 6,167,929 | B1 | * | 1/2001 | Stager et al. | 144/373 |
| 6,463,970 | B1 | * | 10/2002 | Bradshaw | 144/237 |

FOREIGN PATENT DOCUMENTS

| | | | | |
|---|---|---|---|---|
| DE | 3208377 | A1 | 10/1983 | |
| DE | 44 19 324 | A1 | 6/1994 | |
| EP | 0 273 914 | | 10/1986 | |
| EP | 0 663 272 | B1 | 12/1994 | |
| EP | 95 02104 | | 2/1995 | |
| EP | 0 744 255 | A2 | 6/1996 | |
| FR | 2256807 | * | 1/1974 | 144/231 |
| FR | 79 22107 | | 9/1979 | |
| FR | 79 22108 | | 12/1979 | |
| FR | 81 22198 | | 11/1981 | |
| WO | WO 92/22402 | | 12/1992 | |

* cited by examiner

*Primary Examiner*—W. Donald Bray
(74) *Attorney, Agent, or Firm*—Birdwell & Janke, LLP

(57) ABSTRACT

An adjustable profiling head for a wood cutting apparatus. There is a first body portion for carrying a plurality of first knives and a second body portion for carrying a plurality of second knives. The cutting edges of the knives define respective cutting surfaces of revolution about an axis that have different mean diameters for the two body portions. In one aspect of the invention, the body portions are adapted to receive the respective knives by associated knife clamping mechanisms that are adapted to be removably mounted to the body portions with one or more first control plates therebetween, for adjusting the radial positioning of the knives. In another aspect of the invention, the body portions are adapted to be removably mounted to each other so that the body portions are disposed axially adjacent one another with one or more second control plates therebetween, for adjusting the relative axial positioning of the knives of one of the body portions with respect to the knives of the other body portion.

11 Claims, 3 Drawing Sheets

Fig. 5
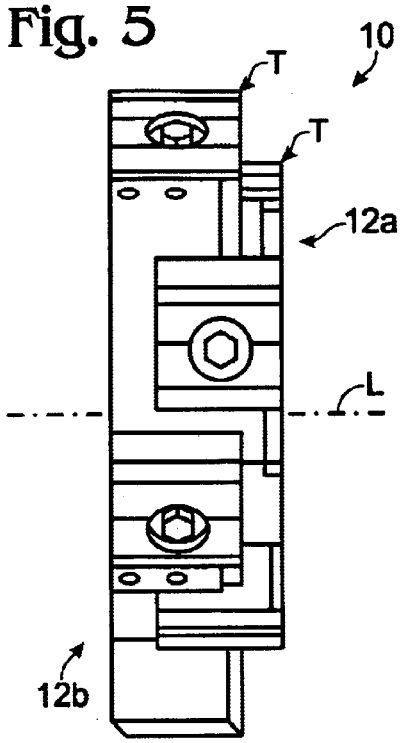
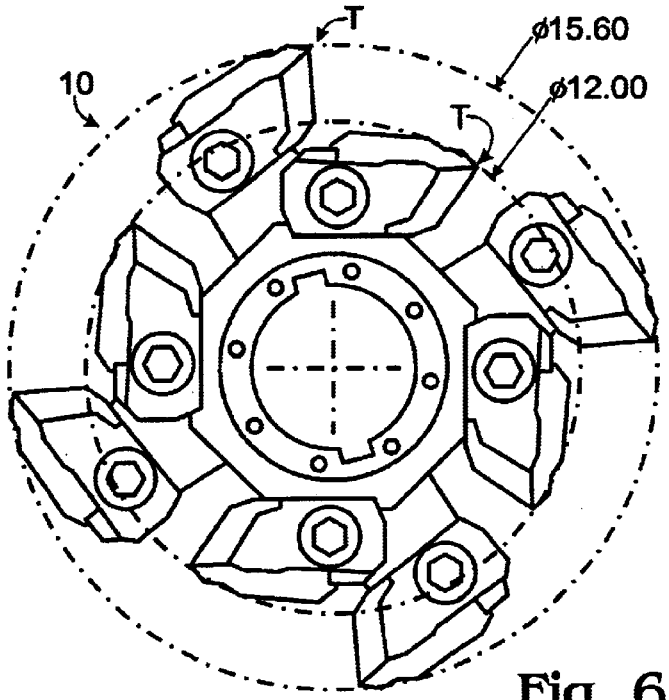
Fig. 6
Fig. 7
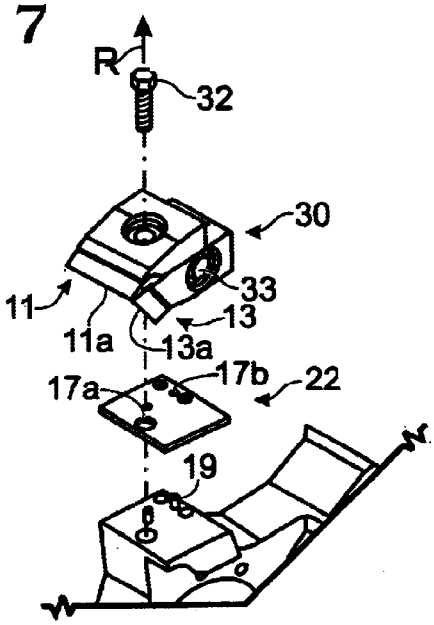

ADJUSTABLE PROFILING HEAD FOR A WOOD CUTTING APPARATUS

FIELD OF THE INVENTION

The present invention relates to an adjustable profiling head for a wood cutting apparatus, such as for use in log and lumber processing in a lumber mill.

BACKGROUND OF THE INVENTION

In order to produce squared lumber from a log, curved or wany edges of the log must be removed. To optimize the number of boards that can be obtained from the log, boards of optimum size are identified that will substantially fill the cross-sectional area of the log, leaving a number of such wany edges. A profiling apparatus is used to cut or chip away the wany edges, and this may be done before the boards are sawed from the log. Particularly, the profiling head cuts a corner that extends along the length of the log and that defines an outer side of one board and at least part of the upper or lower face of an adjacent board. To cut the corner, the profiling head rotates about an axis and has at least one set of first knives oriented at right angles to one another.

The speed of the profiling operation is increased if the wany edges for a number of boards can be removed by the same profiling head. A profiling head that can be used to cut away two wany edges at one time has at least one additional set of knives. The knives of the additional set are disposed a different radial distance from the axis of rotation than the first knives and are displaced axially therefrom as well.

For example, the first knives may be used to cut a first corner defined by an outer side of a first board and at least part of the upper face of a second board that lies beneath and extends beyond the first board. The additional knives may simultaneously be used to cut an adjacent corner defined by an outer side of the second board and at least part of the upper face of a third board that lies beneath and extends beyond the second board. The difference in radial positioning of the first knives relative to the additional knives, as well as the difference in axial positioning of the first knives relative to the additional knives, may define either the thickness of one of the boards or the difference in width between two adjacent boards. The absolute positioning of all of the knives of the profiling heads used to profile the log, in concert with the positioning of the profiling heads themselves, defines the dimensions of board lumber sawn from the log.

Examples of adjustable profiling heads are found in Dietz, Disclosure Document DE 44 19 324 ("Dietz") and Linck, European Patent Application No. 96107714.6 ("Linck"). Dietz discloses an outer corner milling machine and an inner corner milling machine, each resembling a pot, one lying at least partially within the other. Each of the corner milling machines is adapted to cut a corner and is equipped for this purpose with a cleaver on the circumference surface and a plane blade oriented at right angles to the cleaver. "Adjustment units" are used to adjust the axial spacing between the two corner milling machines. The "adjustment units" are not described, but appear to be electric motors. Radial adjustment is not provided, and axial adjustment appears to require feedback control of the motors to find and maintain a command spacing. This spacing can change as a result of the forces encountered by the milling machines and at least some time will be required for the controller and feedback mechanism to restore proper spacing, resulting in imprecise cutting.

Linck discloses a milling head having a large diameter ring of cleavers and a smaller diameter ring of cleavers. The cleavers have their cutting edges aligned with the axis of revolution of the milling head. The cleavers are attached to cleaver carriers which are fastened with screws to respective cleaver supports. The radial disposition of the cleaver supports can be adjusted by loosening the screws. The cleaver supports can also be moved in axial rails within the carriers and can be locked in at different axial positions with terminal blocks and screws. Disksaw segments are installed between the cleavers in the smaller ring. These are stated as being adjustable but no means for adjusting the disksaw segments is disclosed. Moreover, while the position of the cleavers can be adjusted both axially and radially, holding the cleavers in position depends on frictional forces exerted by tightening screws, so that there is no provision for positively locking the position of the cleavers.

Accordingly, there is a need for an adjustable profiling head for a wood cutting apparatus that provides for radial or axial adjustment of the position of knives mounted to the profiling head as well as positive and secure locking of a selected position of the knives.

SUMMARY OF THE INVENTION

The invention disclosed herein is an adjustable profiling head for a wood cutting apparatus. Within the scope of the invention, there is a first body portion for carrying a plurality of first knives and a second body portion for carrying a plurality of second knives. The cutting edges of the knives define respective cutting surfaces of revolution about an axis that have different mean diameters for the two body portions. In one aspect of the invention, the body portions are adapted to receive the respective knives by associated knife clamping mechanisms that are adapted to be removably mounted to the body portions with one or more first control plates therebetween, for adjusting the radial positioning of the knives. In another aspect of the invention, the body portions are adapted to be removably mounted to each other so that the body portions are disposed axially adjacent one another with one or more second control plates therebetween, for adjusting the relative axial positioning of the knives of one of the body portions with respect to the knives of the other body portion.

Therefore, it is an object of the present invention to provide a novel and improved adjustable profiling head for a wood cutting apparatus.

It is a further object of the present invention to provide an adjustable profiling head for a wood cutting apparatus that provides for radial adjustment of the position of knives mounted to the profiling head.

It is still a further object of the present invention to provide an adjustable profiling head for a wood cutting apparatus that provides for axial adjustment of the position of knives mounted to the profiling head.

It is yet a further object of the present invention to provide an adjustable profiling head for a wood cutting apparatus that provides for both radial and axial adjustment of the position of knives mounted to the profiling head.

It is another object of the present invention to provide an adjustable profiling head that provides for positive and secure locking of a selected position of the knives.

The foregoing and other objects, features and advantages of the present invention will be more readily understood upon consideration of the following detailed description of the invention, taken in conjunction with the following drawings.

BRIEF DESCRIPTION OF THE DRAWINGS

FIG. 5 is a side elevation of the adjustable profiling head of FIG. 1.

FIG. 6 is a plan view of the adjustable profiling head of FIG. 1.

FIG. 7 is an exploded detail of FIG. 1.

DETAILED DESCRIPTION OF A PREFERRED EMBODIMENT

Figure 1:
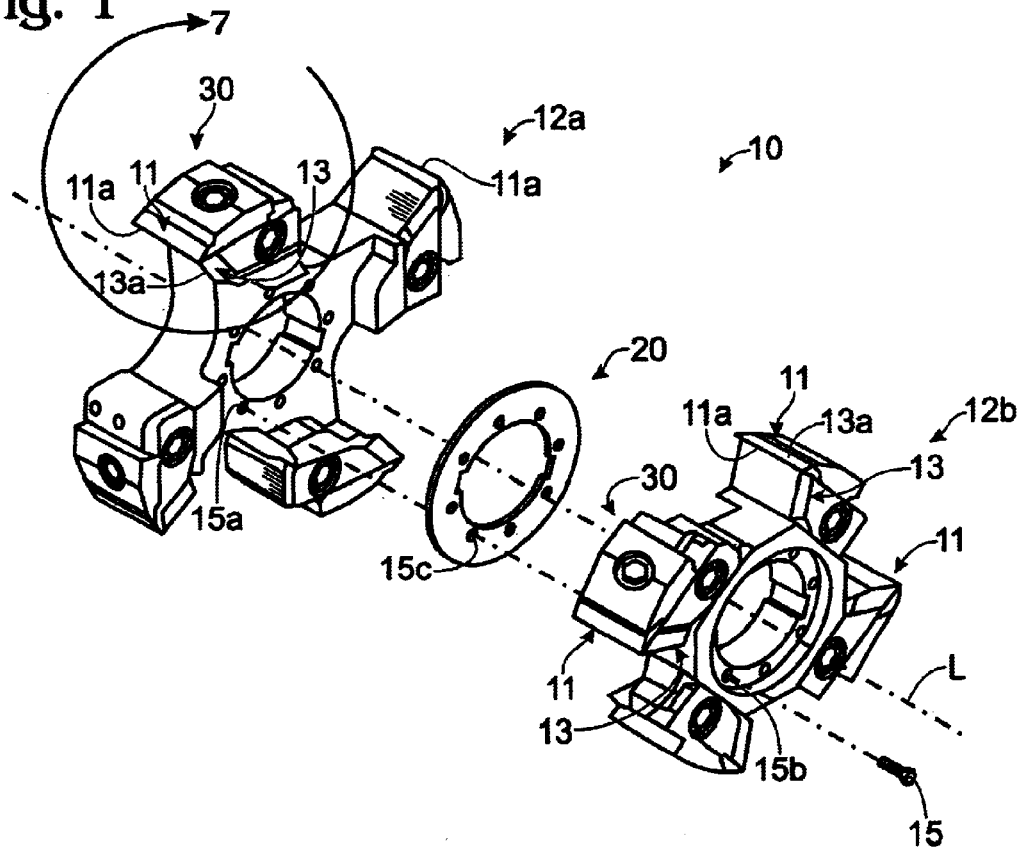
FIG. 1 is an exploded view of an adjustable profiling head according to the present invention.

Referring to FIG. 1, an adjustable profiling head 10 according to the present invention adapted for rotation about an axis "L" preferably has two body portions 12*a* and 12*b* that are removably mounted to one another so that they are disposed axially adjacent one another, such as by the use of bolts 15 extending through corresponding apertures 15*a*, 15*b* in the body portions 12.

Figure 2:
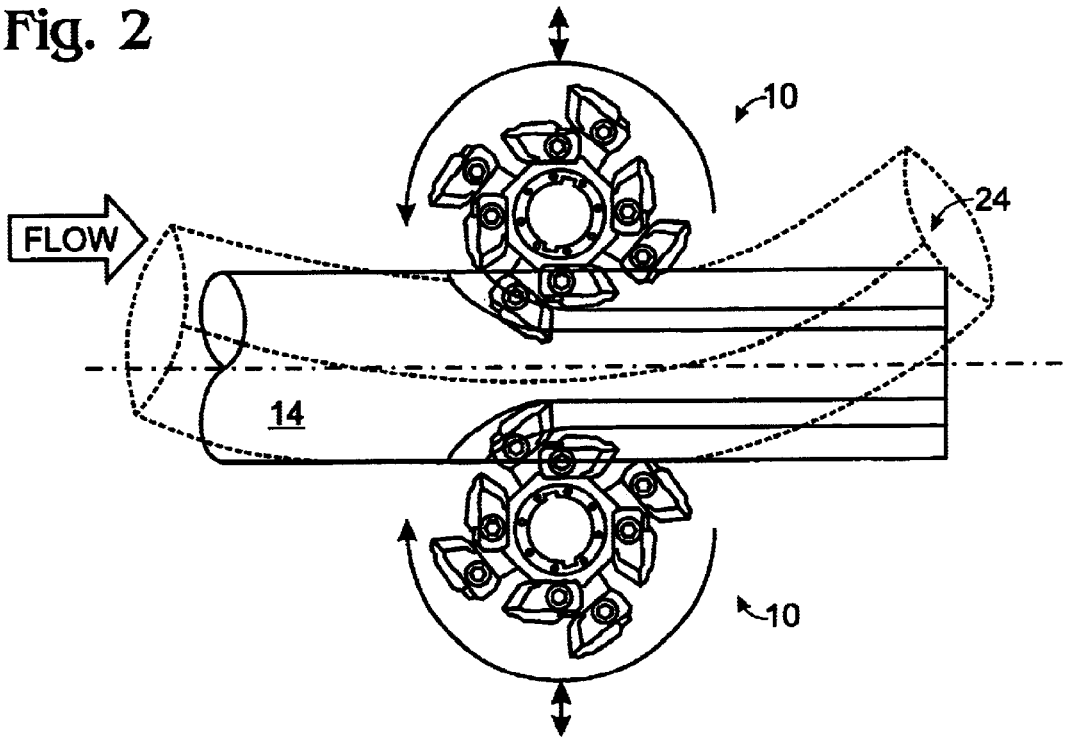
FIG. 2 is a side elevation showing two of four profiling heads as in FIG. 1 being used to cut chips from a log.
Figure 3:
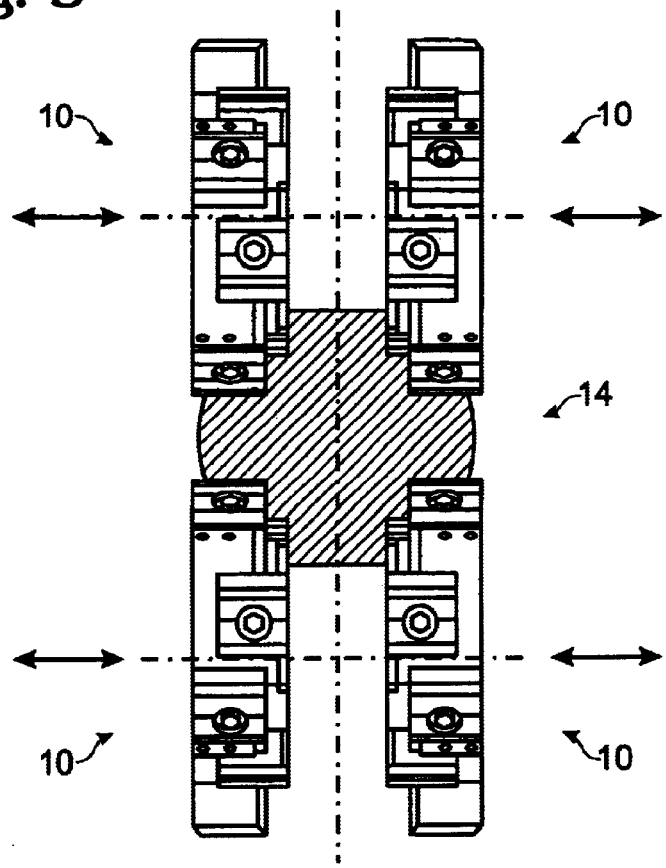
FIG. 3 is an end view of the profiling heads and log of FIG. 2.
Figure 4A:
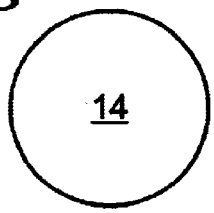
FIG. 4A is a cross-section of an unprocessed log.
Figure 4C:
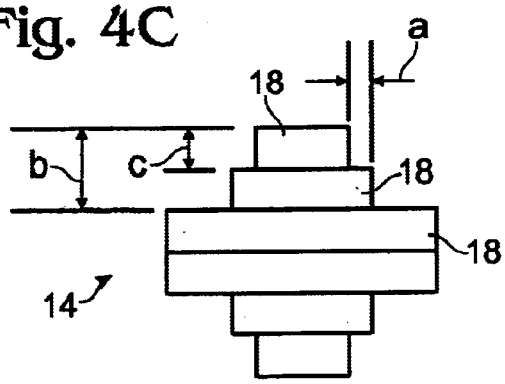
FIG. 4C is a cross-section of the log of FIG. 4B showing boards sawn from the log.
Figure 4B:
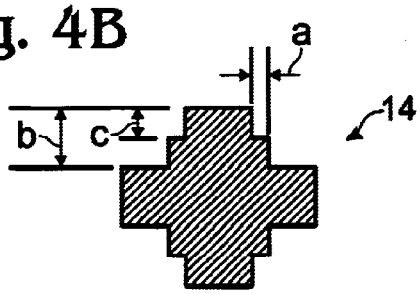
FIG. 4B is a cross-section of the log of FIG. 4A having wany edges removed according to the invention.

Turning to FIGS. 2 and 3, four of the profiling heads are typically provided in a wood cutting apparatus, and each body portion 12 carries a set of removable knives. The apparatus may be used for cutting any article of wood, but is typically used in a lumber mill to convert logs to board lumber. In that context, a log 14 is passed in the direction indicated by the arrow past the profiling heads, which cut the log to configure it from the circular cross-section depicted in FIG. 4A to that depicted in FIG. 4B. By cutting wany edges from the log with the profiling heads, the cross-section of the log as shown in FIG. 4B has been optimized for cutting pieces 18 of board lumber, as depicted in FIG. 4C. The profiling heads may be moved in the direction of the arrows shown in FIG. 3 to accommodate logs of different diameters.

Returning to FIG. 1, a preferred adjustable profiling head 10 according to the present invention has two sets of knives 11, 13 with associated cutting edges 11*a*, 13*a*. However, variations in the number and disposition of the knives may be made without departing from the principles of the invention.

In one aspect of the invention, as can be seen in FIG. 1 with further reference to FIG. 5, the body portions 12 of the profiling head interlock together when disposed axially adjacent one another so that the knives attached to the portion 12*b* are overlappingly axially displaced with respect to the knives attached to the portion 12*a*. Where the cutting edges 13*a* are perpendicular to the axis "L" such as is shown, the cutting edges define an annular cutting surface of revolution as the profiling head rotates about this axis, though such an orientation of the cutting edges 13*a* is not essential to the invention. The annular cutting surfaces of the two body portions 12*a*, 12*b* correspond to the two cut surfaces defined by the dimension "a" in FIG. 4B.

An outstanding feature of the profiling head 10 according to the first aspect of the invention is that it provides for adjusting the relative axial positioning of the body portions 12, by the inclusion or deletion of one or more control plates 20, as shown in FIG. 1. Referring to FIG. 4C, the difference "a" in the relative axial positioning of the body portions defines either the thickness of one board 18, or a difference in the width of two adjacent boards 18 as depicted. The control plates provide for such positioning in discrete, precisely defined steps, and positioning is positively and accurately maintained without readjustment regardless of the amount of use and wear of the profiling head. Adjusting the number of the control plates 20 adjusts the dimension "a." The control plates may be particularly adapted for this purpose by including apertures 15*c* matching corresponding apertures 15*a* and 15*b*, permitting the bolts 15 used to mount the body portions 12 together to pass therethrough. Other adaptations of the control plates 20 and the body portions 12 may be employed to achieve the same function without departing from the principles of the invention.

Turning to a second aspect of the invention, which may employed in conjunction with the first aspect or separately, the knives 11, 13 are clamped to their respective body portions 12 by associated clamping mechanisms 30. The clamping mechanisms are removably mounted to the respective body portions, such as by use of the bolt 32 as shown in FIG. 7. As shown, the bolt 32 clamps the knife 11 to a body portion 12 along with the clamping mechanism itself, while a similar bolt 33 clamps the knife 13 to the clamping mechanism. Other configurations of the clamping mechanism 30 for clamping the knives 11, 13, and other schemes for removably mounting the clamping mechanisms to the body portions 12 may be employed without departing from the principles of the invention.

Where the cutting edges 11*a* are parallel to the axis "L" as shown, they define a cylindrical cutting surface of revolution as the profiling head rotates about this axis, though such an orientation of the cutting edges 11*a* is not essential to the invention. The cutting surfaces defined by the cutting edges 11*a* for one of the body portions 12 generally have a different diameter than the cutting surfaces defined by the cutting edges 11*a* for the other body portion. For example, with reference to FIG. 6, radially outermost tips "T" of the knives attached to the body portion 12*a* define a circle having a first diameter, e.g., 15.6", where similarly defined tips of the knives attached to the body portion 12*b* define a circle having a smaller diameter, e.g., 12.0". The body portions themselves have different diameters to provide for such base radial positioning of the knives, as can be seen by inspection of FIG. 1.

In addition, according to the second aspect of the invention, the profiling head 10 provides for adjusting the radial positioning of the knives 11, 13, from their base radial positioning as defined by the body portions 12 themselves, by the inclusion or deletion of one or more control plates 22 between the clamping mechanisms and the body portions 12. The cutting surfaces defined by the knives 11 of the two body portions 12 correspond to the cut surfaces depicted in FIG. 4B defined by the dimensions "b" and "c," respectively. Adjusting the number of control plates 22 independently for the clamping mechanisms associated with each of the body portions 12 provides for independent control of the dimensions "b" and "c." The control plates 22 may be particularly adapted for this purpose by including apertures 17*a* and 17*b*. The aperture 17*a* accepts the bolt 32 used to mount the clamping mechanism 30 to the body portions 12, and the aperture 17*b* accepts a pin 19 to hold the control plate in place during assembly. Other adaptations of the control plates 22, the clamping mechanisms 30 and the body portions 12 may be employed to achieve the same function without departing from the principles of the invention.

Similar to the case of the control plates 20, the control plates 22 provide for adjusting the position of the knives 11, 13 in discrete, precisely defined steps, and positioning is positively and accurately maintained without readjustment regardless of the amount of use and wear of the profiling head.

In addition to the outstanding advantages provided by the control plates 20 and 22 mentioned above, the control plates are highly economical to produce, and provide for substantially reducing the mechanical complexity of the profiling head, resulting in further savings in initial cost, maintenance and repair. By use of both sets of control plates 20 and 22, the dimensions "a," "b," and "c" shown in FIGS. 4B and 4C may all be optimized to minimize the amount of the wany material that must be removed from the log and thereby to maximize the size of the pieces 18 of lumber.

In consideration of a third aspect of the invention, it may be noted by referring back to FIG. 2 that the log 14 may be curved, having a curved elongate axis 24. In that circumstance, the heads 10 may all be moved together, upwardly or downwardly in the direction of the arrows, to follow the curvature of the log as it is fed along the direction of flow. This permits profiling a curved log according to the invention in such manner as to follow the grain, which optimizes the strength of the resulting lumber. The curved boards resulting from profiling the curved log may be straightened in subsequent processing with known techniques.

It will be recognized by persons of ordinary skill that the aforedescribed second and third aspects of the invention apply as well to a profiling head having just one of the body portions 12 or their equivalents, and that all three of the aspects described above apply to profiling heads incorporating any number of additional body portions or their equivalents, for cutting more than two corners.

It is further to be recognized that, while a particular adjustable profiling head for a wood cutting apparatus has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. An adjustable profiling head for a wood cutting apparatus, comprising:

a body portion for carrying a plurality of knives having cutting edges defining thereby a cutting surface of revolution about an axis, said body portion being adapted to receive said knives by respective clamping mechanisms for removably clamping said knives thereto; and a set of control plates, wherein each of said clamping mechanisms is adapted to be removably mounted to said body portion, and wherein said clamping mechanisms are adapted to mount to said body portion by one or more associated bolts passing through an associated one or more of said control plates.

2. An adjustable profiling head for a wood cutting apparatus, comprising:

a first body portion for carrying a plurality of first knives having cutting edges defining thereby a first cutting surface of revolution about an axis, said first body portion being adapted to receive said first knives by respective clamping mechanisms for removably clamping said first knives thereto;

a second body portion for carrying a plurality of second knives having cutting edges defining thereby a second cutting surface of revolution about said axis, said second body portion being adapted to receive said second knives by respective clamping mechanisms for removably clamping said second knives thereto, wherein said first and second body portions are adapted so that the mean diameter of said first cutting surface is greater than the mean diameter of said second cutting surface, and wherein said first and second body portions are adapted to be removably mounted axially adjacent one another so that the respective said cutting surfaces are axially displaced with respect to one another an adjustable amount.

3. The profiling head of claim 2, further comprising a set of first control plates, wherein said first and second body portions are adapted to mount to one another by a plurality of bolts passing through an associated one or more of said first control plates.

4. The profiling head of claim 2, wherein said first and second body portions are adapted so that the mean diameter of said first cutting surface is greater than the mean diameter of said second cutting surface by an adjustable amount.

5. The profiling head of claim 3, wherein said first and second body portions are adapted so that the mean diameter of said first cutting surface is greater than the mean diameter of said second cutting surface by an adjustable amount.

6. The profiling head of claim 5, further comprising a set of second control plates, wherein said clamping mechanisms are adapted to be removably mounted to said body portions, and wherein said clamping mechanisms are adapted to mount to said body portions by one or more associated bolts passing through an associated one or more of said second control plates.

7. An adjustable profiling head for a wood cutting apparatus, comprising:

a first body portion for carrying a plurality of first knives having cutting edges defining thereby a first cutting surface of revolution about an axis, said first body portion being adapted to receive said first knives by respective clamping mechanisms for removably clamping said first knives thereto;

a second body portion for carrying a plurality of second knives having cutting edges defining thereby a second cutting surface of revolution about said axis, said second body portion being adapted to receive said second knives by respective clamping mechanisms for removably clamping said second knives thereto, wherein said first and second body portions are adapted so that the mean diameter of said first cutting surface is greater than the mean diameter of said second cutting surface by an adjustable amount, and wherein said first and second body portions are adapted to be removably mounted axially adjacent one another.

8. The profiling head of claim 7, further comprising a set of control plates, wherein each of said clamping mechanisms is adapted to be removably mounted to said body portions, and wherein said clamping mechanisms are adapted to mount to said body portions by one or more associated bolts passing through an associated one or more of said control plates.

9. A method for adjusting a profiling head, comprising the steps of:

providing a first body portion of the profiling head for carrying a plurality of first knives having cutting edges defining thereby a first cutting surface of revolution about an axis, said first body portion being adapted to receive said first knives by respective clamping mechanisms for removably clamping said first knives thereto;

providing a second body portion of the profiling head for carrying a plurality of second knives having cutting edges defining thereby a second cutting surface of revolution about said axis, said second body portion being adapted to receive said second knives by respective clamping mechanisms for removably clamping said second knives thereto, wherein said first and second body portions are adapted so that the mean diameter of said first cutting surface is greater than the mean diameter of said second cutting surface;

providing a plurality of control plates; and removably mounting one of said body portions to the other so as to result in said body portions being disposed axially adjacent one another with a selected one or more of said control plates therebetween, so that the respective said cutting surfaces are axially displaced with respect to one another a selected amount.

10. A method for adjusting a profiling head, comprising the steps of:

providing a first body portion for carrying a plurality of first knives having cutting edges defining thereby a first cutting surface of revolution about an axis, said first body portion being adapted to receive said first knives by respective clamping mechanisms for removably clamping said first knives thereto;

providing a second body portion for carrying a plurality of second knives having cutting edges defining thereby a second cutting surface of revolution about said axis, said second body portion being adapted to receive said second knives by respective clamping mechanisms for removably clamping said second knives thereto, wherein said first and second body portions are adapted so that the mean diameter of said first cutting surface is greater than the mean diameter of said second cutting surface;

providing a plurality of first control plates; and removably mounting at least one of said clamping mechanisms from said first body portion with a selected one or more of said control plates therebetween, so that the mean diameter of said first cutting surface is greater than the mean diameter of said second cutting surface by a selected amount.

11. The method of claim 10, further comprising providing a plurality of second control plates and removably mounting one of said body portions to the other so as to result in said body portions being disposed axially adjacent one another with a selected one or more of said second control plates therebetween, so that the respective said cutting surfaces are axially displaced with respect to one another a selected amount.

* * * * *